US011008163B2

(12) United States Patent
Wang et al.

(10) Patent No.: US 11,008,163 B2
(45) Date of Patent: May 18, 2021

(54) CONTAINER WITH TOUCH CONTROL ARRANGEMENT

(71) Applicant: FUJIAN NASHIDA ELECTRONIC INCORPORATED COMPANY, Fujian (CN)

(72) Inventors: Xin Wang, Fuzhou (CN); Jiangqun Chen, Fuzhou (CN); Xiujin Yang, Fuzhou (CN); Huiyang Zheng, Fuzhou (CN); Zhou Lin, Fuzhou (CN)

(73) Assignee: Nine Stars Group (U.S.A.) Inc., Ontario, CA (US)

( * ) Notice: Subject to any disclaimer, the term of this patent is extended or adjusted under 35 U.S.C. 154(b) by 242 days.

(21) Appl. No.: 16/079,084

(22) PCT Filed: Mar. 9, 2017

(86) PCT No.: PCT/CN2017/076096
§ 371 (c)(1),
(2) Date: Aug. 22, 2018

(87) PCT Pub. No.: WO2018/133184
PCT Pub. Date: Jul. 26, 2018

(65) Prior Publication Data

US 2019/0055087 A1 Feb. 21, 2019

(30) Foreign Application Priority Data

Jan. 20, 2017 (CN) ..... 201720069628.6

(51) Int. Cl.
*B65F 1/16* (2006.01)
*B65F 1/06* (2006.01)

(52) U.S. Cl.
CPC ..... *B65F 1/1638* (2013.01); *B65F 1/06* (2013.01); *B65F 1/1646* (2013.01)

(58) Field of Classification Search
CPC ..... B65F 1/06; B65F 1/1646; B65F 1/1638
USPC ..... 220/221
See application file for complete search history.

(56) References Cited

U.S. PATENT DOCUMENTS 8,678,219 B1 * 3/2014 Wang ..... B65F 1/163 220/211
9,054,609 B2 * 6/2015 Wang ..... B65F 1/06

* cited by examiner

*Primary Examiner* — Anthony D Stashick
*Assistant Examiner* — James M Van Buskirk
(74) *Attorney, Agent, or Firm* — Raymond Y. Chan; David and Raymond Patent Firm

(57) ABSTRACT

A container includes a container cover, a cover resilient element, a holding unit, a container body, a connecting unit, a speed adjustor, an electric motor, a circuit board module, an inner supporting frame, an outer supporting frame, a touch control arrangement, wherein the connecting unit is coupled at an outer side of the container body to pivotally connect the container cover with the container body. The cover resilient element is arranged for applying a resilient force against the container cover. The container body has an accessing cavity, wherein the touch control arrangement is supported at the accessing cavity. The structural configuration of the container is simplified that the container requires less components and less complicated structural configuration. The cost and the power consumption of the container are relatively low. The container is easy to use and is able to maintain the container cover the opening position.

20 Claims, 10 Drawing Sheets

CONTAINER WITH TOUCH CONTROL ARRANGEMENT

CROSS REFERENCE OF RELATED APPLICATION

This is a non-provisional application that claims priority to international application number PCT/CN2017/076096, international filing date Mar. 9, 2017, which claims priority to Chinese application CN 201720069628.6, filing date Jan. 20, 2017, the entire contents of each of which are expressly incorporated herein by reference.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to containers, and more particularly to a container with a touch control arrangement.

Description of Related Arts

There are generally two types of automatic trash container.

The first type is an induction actuated trash container which comprises an infrared sensor being activated in response to a presence of a user to open and close a container cover. However, the major drawback of the induction actuated trash container is that the infrared sensor must be maintained in an always-on standby mode to continuously transmit the infrared signal. As a result, it is a waste that the infrared sensor consumes relatively lots of electrical power in the standby mode. In other words, the user may need to replace the battery for the induction actuated trash container frequently due to the energy hog of the infrared sensor. In addition, the induction actuated trash container is misused that the container cover is accidentally opened up when the infrared sensor detects a pet passing in front of the infrared sensor.

Another type is an touch sensor trash container, wherein the conventional touch sensor trash container is unreliable. Accordingly, the conventional touch sensor trash container comprises a micro switch electrically connected to a control circuit via a plug connector. The conventional touch sensor trash container further comprises a head unit for holding a trash bag within the a container body. In order to remove the trashes in the trash bag from the trash container, the user must detach the head unit from the container body. It is inconvenient for the user to detach and re-attach the head unit to the container body every time when replacing the trash bag. Furthermore, the control circuit will be polluted by the trashes and the connection between the micro switch and the control circuit will be damaged and oxidized, so as to cause an improper operation of the trash container. In addition, such trash container requires an inner container to separate the electronic components from the trashes. On the other hand, the cost of the trash container will be relatively high to include the inner container. An improved touch sensor trash container can omit the inner container. However, the electronic components may be polluted by the trashes. Without the inner container, the trash container require more container components for actuating the container cover, wherein the configuration or arrangement of the container components is unreliable and is complicated. As a result, the trash bag cannot be held properly and the cost of the trash container will be higher comparing with the trash container having the inner container.

SUMMARY OF THE PRESENT INVENTION

The invention is advantageous in that it provides a container, such as a trash container, with a touch control arrangement, wherein the structural configuration of the container is simplified and reasonable, and is easy to use.

According to the present invention, the foregoing and other objects and advantages are attained by a container comprises a container cover, a cover resilient element, a container body, a connecting unit, a speed adjustor such as a decelerator, an electric motor, a circuit board module, an inner supporting frame, an outer supporting frame, a touch control arrangement. The container cover is pivotally connected to the container body via the connecting unit, wherein the connecting unit is coupled at an outer side of the container body to pivotally connect to the container cover. In particular, the container cover has two cover axle slots and connecting unit has two connecting axle slots coaxially aligned with the cover axle slots, wherein an axle shaft is extended through the cover axle slot and the connecting axle slot to pivotally connect the container cover to the container body. The cover resilient element is connected at the axle shaft to bias against the container cover and the container body. The inner supporting frame and the outer supporting frame are mounted at the bottom of the container body, wherein a front opening cavity is formed in front of the inner supporting frame and the outer supporting frame. The container body has a notch aligned with the front opening cavity to form an accessing cavity, wherein the touch control arrangement is supported at the accessing cavity. In one embodiment, the cover resilient element is a coil spring and is arranged for applying a resilient force against the container cover with respect to the container body. In particular, the resilient force, i.e. the spring force, of the cover resilient element will compensate most of the weight of the container cover. As a result, the electric motor requires generating less power to pivotally lift up the container cover from the container body. In other words, the size of the electric motor as proportional to its power generation and the cost of the electric motor will be reduced, so as to prolong the service life span of the electric motor. Accordingly, the connecting unit, the speed adjustor, the electric motor, the circuit board module, and a battery are supported and installed at the outer side of the container body to maximize an interior storage cavity of the container body. In addition, the connecting unit, the speed adjustor, the electric motor, the circuit board module, and the battery are located at the rear side of the container body to keep the aesthetic appearance of the container body. The touch control arrangement is supported within the accessing cavity at the front bottom side of the container body to form an integrated body for keeping the aesthetic appearance of the container body. The touch control arrangement is electrically connected to the circuit board module to activate the electric motor and the speed adjustor, so as to pivotally lift up the container cover.

The container cover comprises a sector gear provided at a rear bottom portion thereof and at a position between the cover axle slots, wherein the sector gear is engaged with an output gear of the speed adjustor. The connecting axle slots are formed at an upper portion of the container body, wherein the connecting unit has a planner shape that lower portion thereof is coupled at the container body. Accordingly, an axis of the sector gear, a center of each of the cover axle slots, and a center of each of the connecting axle slots are coaxially aligned with each other to form a pivot axle channel, such that the axle shaft, which is preferably made of metal, is slidably coupled at the pivot axle channel to pivotally connect the container cover with the connecting unit. It is worth mentioning that the container cover, the sector gear, and the cover axle slots are integrally formed as a one piece member via mold injection. In other words, the sector gear is integrally extended from the container cover while the cover axle slots are integrally formed at the upper portion of the container cover when the container cover is formed via mold injection, so as to ensure the precise configuration of the sector gear and the cover axle slots with respect to the container cover and to reduce the manufacturing cost thereof. The output gear is directly engaged with the sector gear to enhance the gear efficiency and to minimize the mechanical wear out of the gear. Preferably, the axle shaft is made of metal to provide a high strength ability to prevent any distortion through the pivotal movement of the container cover. In addition, the cover resilient element is coupled at the axle shaft, wherein the cover resilient element has one end biasing against the connecting unit and another end biasing against the container cover for applying the resilient force against the container cover so as to compensate most of the weight of the container cover.

The connecting unit further comprises a battery compartment integrally formed therein via mold injection. Accordingly, the speed adjustor, the electric motor, the circuit board module are orderly mounted at the connecting unit from top to bottom thereof to form a power assembly, such that the electric motor is located between the speed adjustor and the circuit board module. The connecting unit is coupled at the rear upper side of the container body via screws. A unit casing is detachably coupled at the connecting unit to enclose the speed adjustor, the electric motor, the circuit board module. It is worth mentioning that speed adjustor, the electric motor, the circuit board module can be manufactured individually or separately for enhancing the mass production of the components and for reducing the costs thereof.

The touch control arrangement comprises a touch supporting frame, a touch panel, a micro switch, and a touch control resilient element. The touch supporting frame is coupled at the notch of the container body, wherein an upper portion of the touch supporting frame is coupled at the inner supporting frame while a lower portion of the touch supporting frame is coupled at the outer supporting frame. The touch panel is pivotally coupled at the touch supporting frame. In one embodiment, an upper portion of the touch panel is pivotally coupled at the upper portion of the touch supporting frame, such that a bottom portion of the touch panel is adapted to pivotally move into the touch supporting frame. The touch control resilient element is coupled at a pivot connection between the touch supporting frame and the touch panel. The micro switch is supported by the touch supporting frame. The touch panel comprises an actuating member protruded from an inner side thereof and alignedly contacted with the micro switch. In one embodiment, the touch control resilient element comprises a coil spring for applying a resilient force to the touch panel. When the touch panel is pivotally pushed inward by a user's foot to compress the touch control resilient element, the actuating member is driven to move away from the micro switch. It is worth mentioning that the pivot angle of the touch panel is relatively small in order to disengage the actuating member with the micro switch. Accordingly, the micro switch is electrified to generate an activation signal to the circuit board module. When the user's foot moves away from the touch panel, the touch control resilient element is then restored to its original form to pivotally push the touch panel back to its original position, such that the actuating member is moved back to contact with the micro switch. The micro switch is disconnected once the actuating member is contacted with the micro switch.

The circuit board module comprises a microprocessor, a driver circuit, a braking circuit, and a photocoupler. The electric motor comprises a first output shaft and a second output shaft. The first output shaft of the electric motor is engaged with a primary gear of the speed adjustor. The second output shaft of the electric motor is connected to a grating. The grating is arranged to selectively block a light ray from the photocoupler. The microprocessor has an input terminal electrically connected to the micro switch. A signal output terminal of the photocoupler is electrically connected to the calculating terminal of the microprocessor. When the electric motor is activated to generate a rotatable power, the first output shaft of the electric motor is driven to rotate to rotate the primary gear of the speed adjustor so as to pivotally lift up the container cover through the speed adjustor to slow down the opening/closing speed of the container cover. At the same time, the second output shaft of the electric motor is driven to rotate to rotate the grating. The photocoupler generates an impulse signal, wherein the microprocessor will receive and determine the impulse signal. The microprocessor will then continuously generate a feedback value with respect to a pivot angle (opening angle) of the container cover. Accordingly, the electric motor is electrically connected and disconnected in response to the current feedback value.

A wiring slot is formed between the inner supporting frame and the outer supporting frame. A wiring panel is coupled at the rear side of the container body. Accordingly, the micro switch comprises a connecting wire extended through the wiring slot between the inner supporting frame and the outer supporting frame, and is detoured and guided along the wiring panel in order to connect with the circuit board module. One side of the wiring panel is coupled at the outer supporting frame while another side of the wiring panel is coupled at the connecting unit. The wiring panel is arranged to protectively cover the connecting wire.

The holding unit is constructed to have the outer holding ring and the inner holding ring. The outer holding ring is sleeved to and encircled around a top opening of the container body while the inner holding ring is encircled within the outer holding ring. Accordingly, an opening edge portion of a plastic bag (trash bag) is held by the outer holding ring and the inner holding ring. In particularly, when the plastic bag is disposed in the container body, the inner holding ring is coupled at an inner side of the container body to hold the opening edge portion of the plastic bag between the inner side of the container body and the inner holding ring. Then, the opening edge portion of the plastic bag can be outwardly folded to overlap on an outer side of the container body, such that the outer holding ring is coupled at the outer side of the container body to hold the folded opening edge portion of the plastic bag between the outer side of the container body and the outer holding ring. Therefore, the container of the present invention does not require any inner container body to hold the plastic bag to further reduce the manufacturing cost of the container. Since the folded opening edge portion of the plastic bag is encircled and hidden within the outer holding ring, the plastic bag cannot be seen from the exterior of the container so as to keep the aesthetic appearance of the container.

The input terminal of the microprocessor also has a re-activation function from a sleep mode thereof and a timer function. It is worth mentioning that the input terminal of the microprocessor is electrically connected to the micro switch, wherein when the micro switch is actuated, the electrical level at the input terminal of the microprocessor is changed from high level to low level. Therefore, the micro switch is shifted from the sleep mode (energy saving mode) back to a normal operation mode for opening the container cover. The micro switch is also arranged to determine whether the container cover is stayed at the opening position. At the opening position of the container cover, when the micro switch is kept actuated (touched) to maintain the electrical level at the input terminal of the microprocessor at the low level and the contacting time of the micro switch is larger than 3 seconds, the microprocessor is programmed to maintain the container cover at the opening position (the container cover stays at the opening position). When the contacting time of the micro switch is less than 3 seconds, the container cover will be automatically moved back to its closed position from the opened position after a predetermined time (few seconds). Then, the micro switch is then shifted back to the sleep mode (energy saving mode) from the normal operation mode, so as to complete one working cycle.

The advantages of the present invention is that the structural configuration of the container is simplified and reasonable that the container requires less components and less complicated structural configuration comparing to the conventional container. The cost and the power consumption of the container are relatively low. The container is easy to use and is able to maintain the container cover the opening position.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
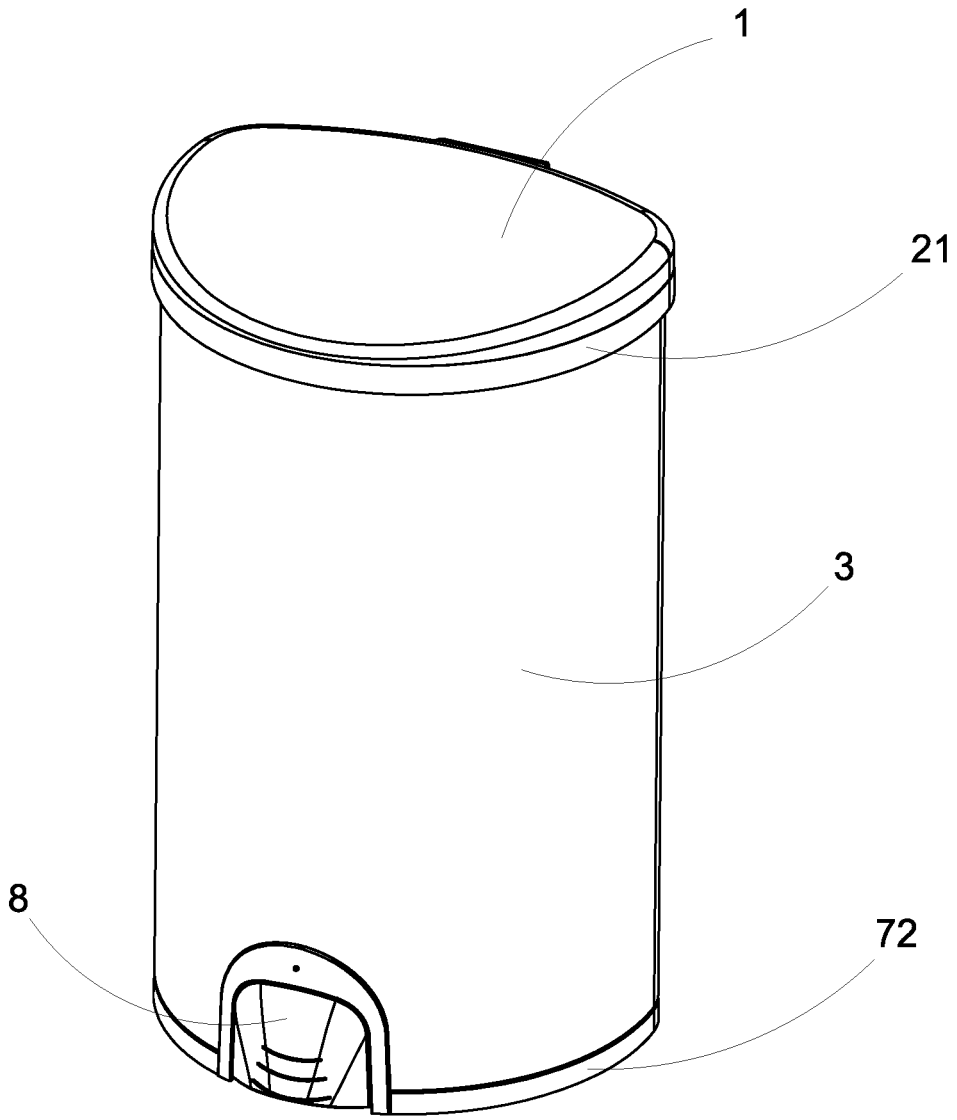
FIG. 1 is a perspective view of a container with a touch control arrangement according to a preferred embodiment of the present invention, illustrating a container cover at a normal closed position.
Figure 2:
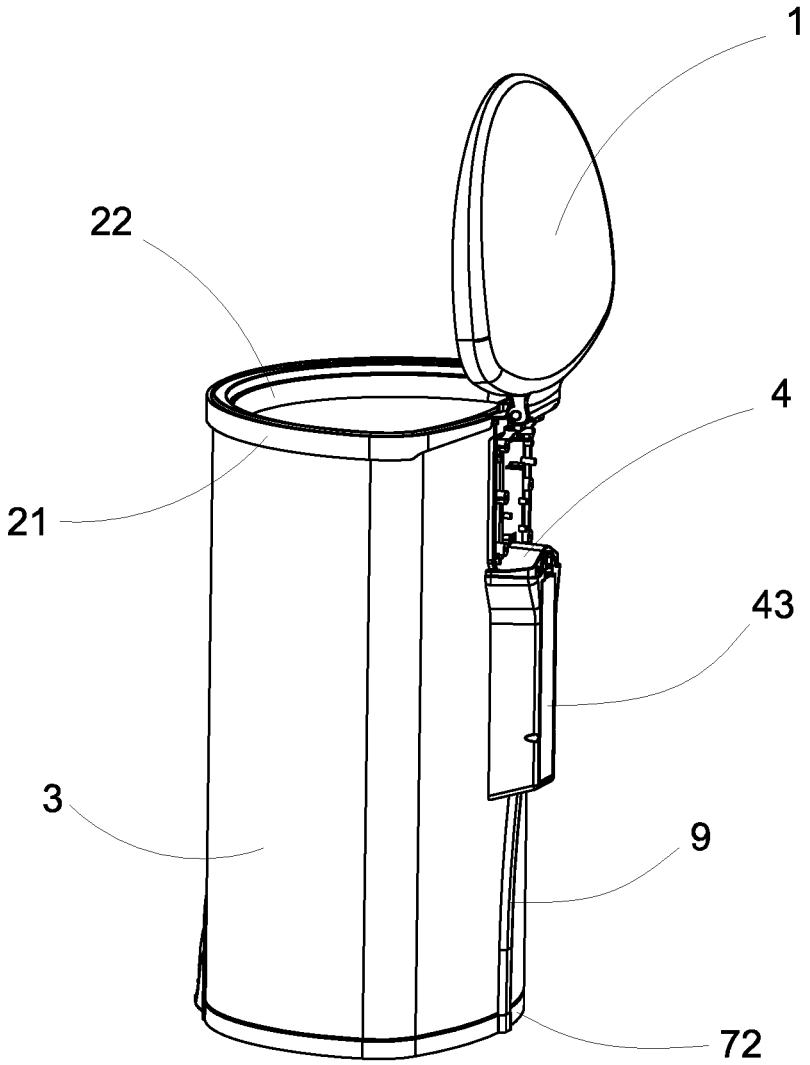
FIG. 2 is a perspective view of the container according to the above preferred embodiment of the present invention, illustrating the container cover at an opened position.
Figure 3:
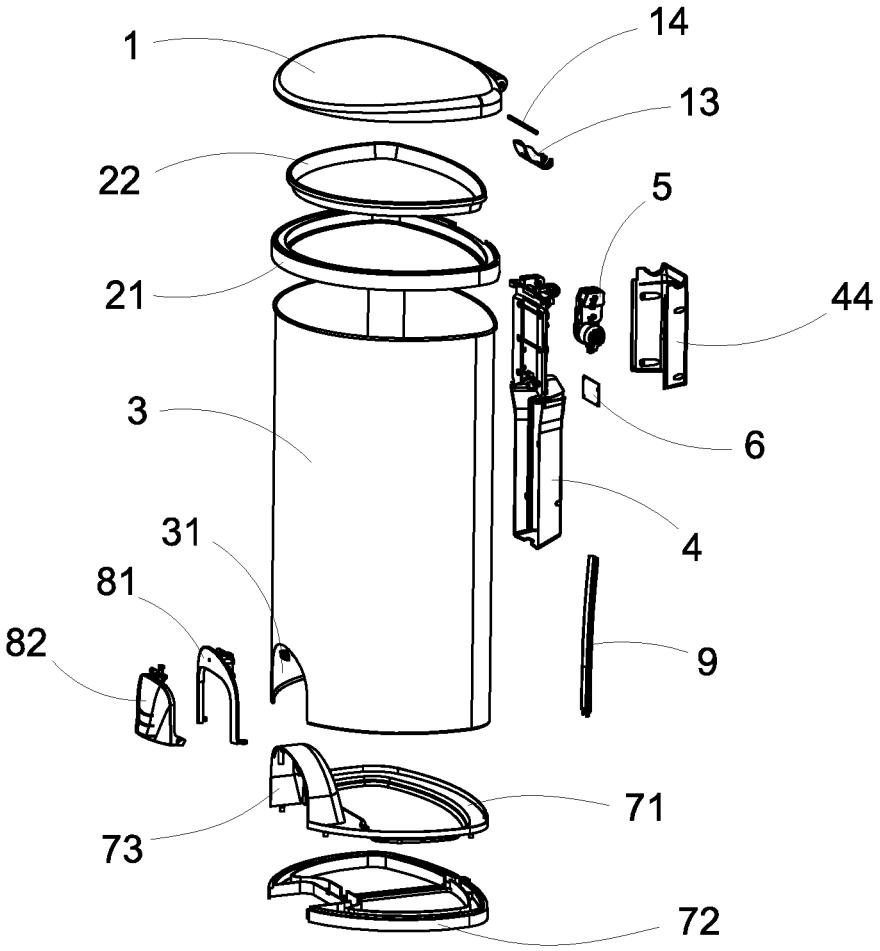
FIG. 3 is an exploded perspective view of the container according to the above preferred embodiment of the present invention.
Figure 4:
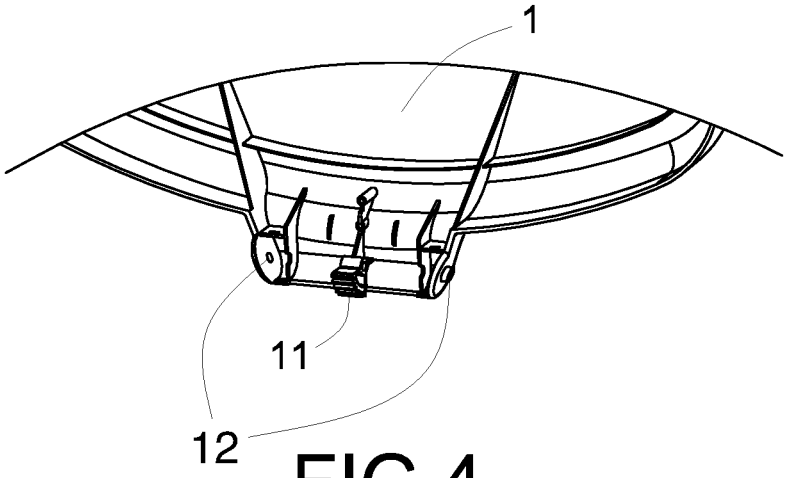
FIG. 4 a partially perspective view of a container cover of the container according to the above preferred embodiment of the present invention.
Figure 5:
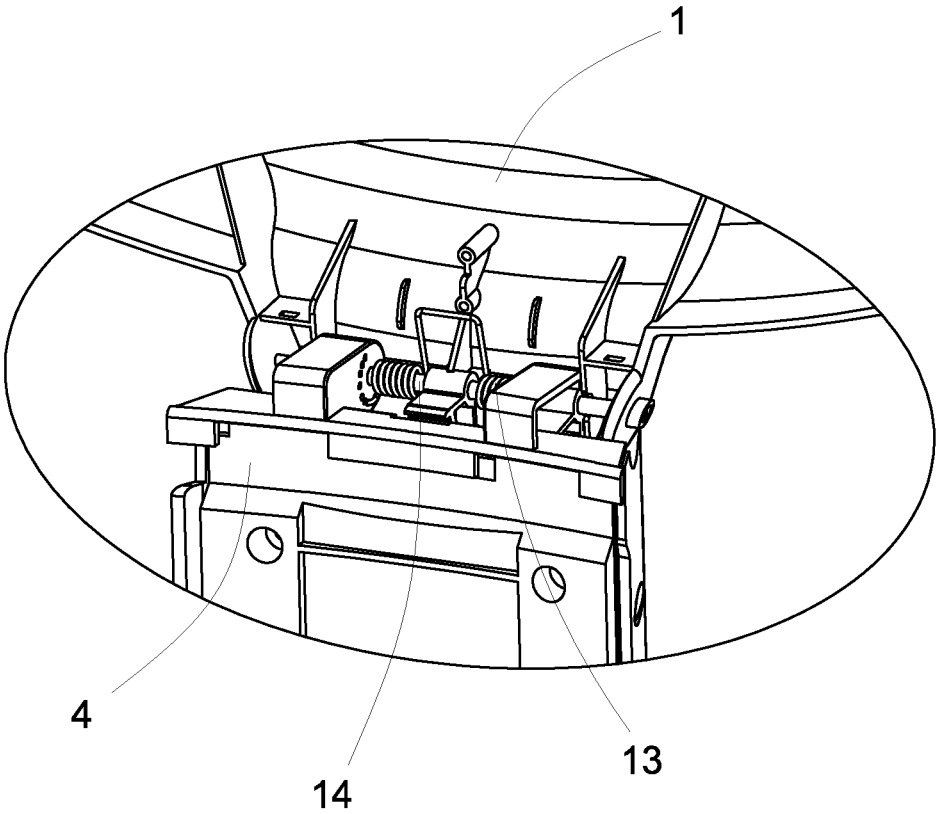
FIG. 5 illustrates a cover hinge of the container according to the above preferred embodiment of the present invention.
Figure 6:
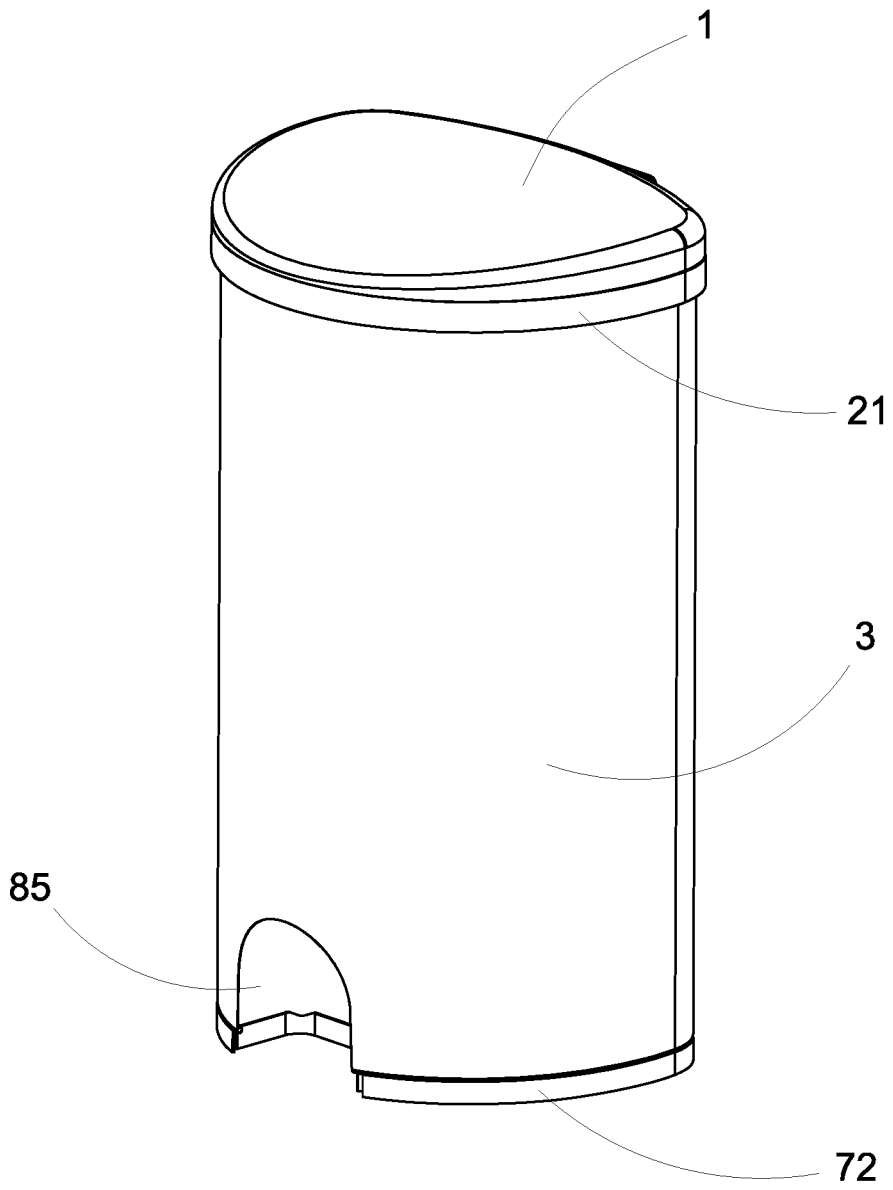
FIG. 6 is a perspective view of the container according to the above preferred embodiment of the present invention, illustrating a front accessing opening of the container.
Figure 7:
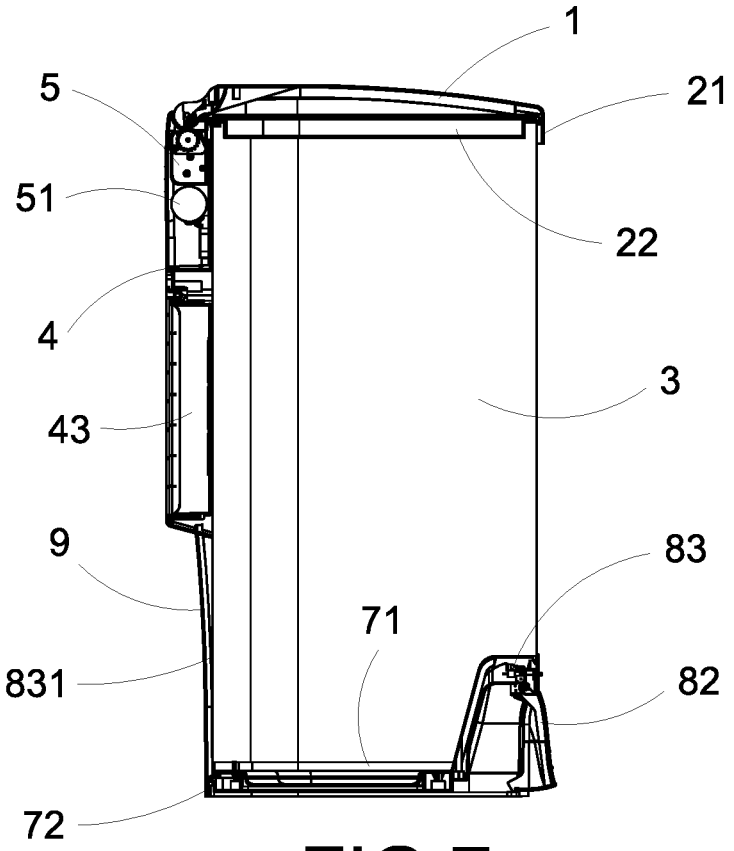
FIG. 7 is a sectional view of the container according to the above preferred embodiment of the present invention.
Figure 8:
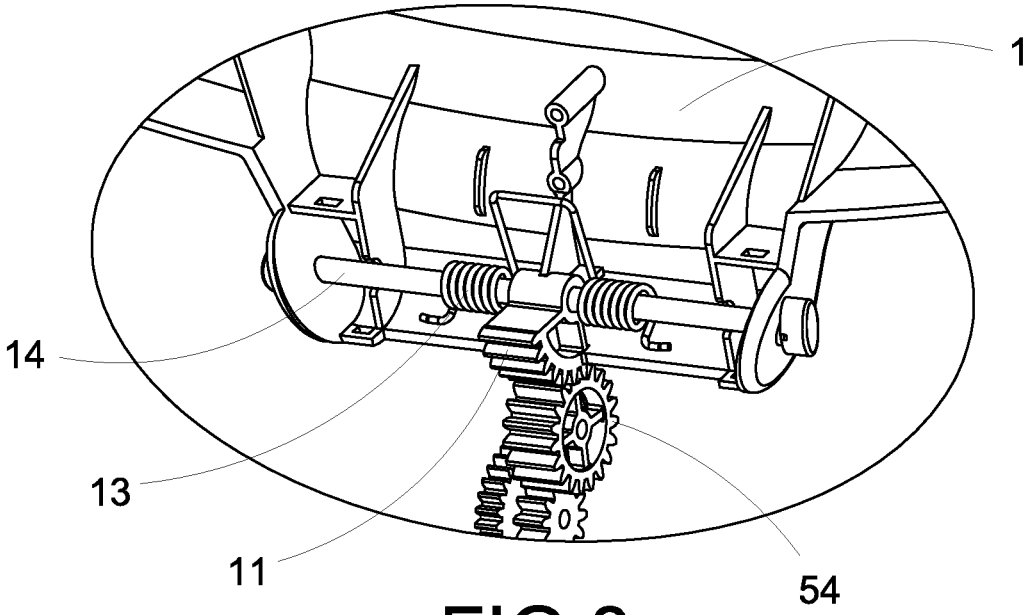
FIG. 8 is a perspective view a gear unit of the container according to the above preferred embodiment of the present invention.
Figure 9:
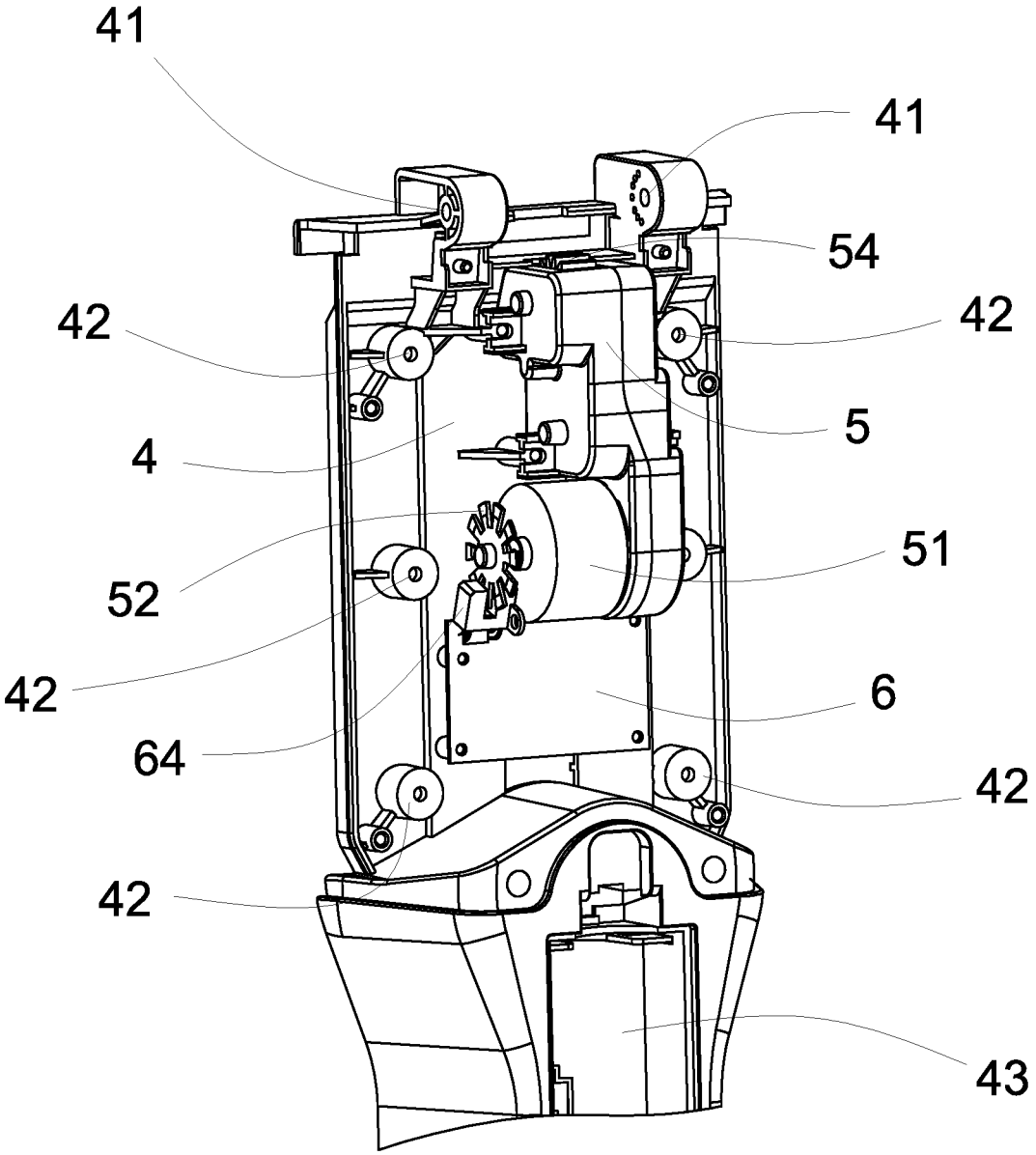
FIG. 9 is a perspective view a cover actuation unit of the container according to the above preferred embodiment of the present invention.
Figure 10:
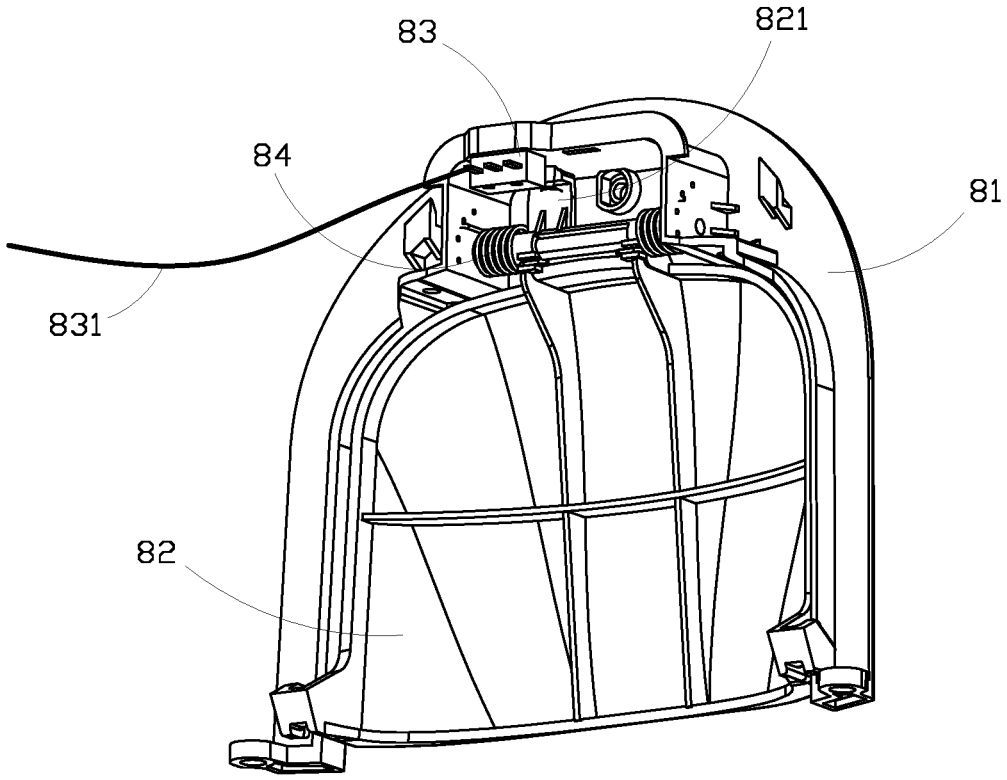
FIG. 10 is a perspective view a touch actuation unit of the container according to the above preferred embodiment of the present invention.
Figure 11:
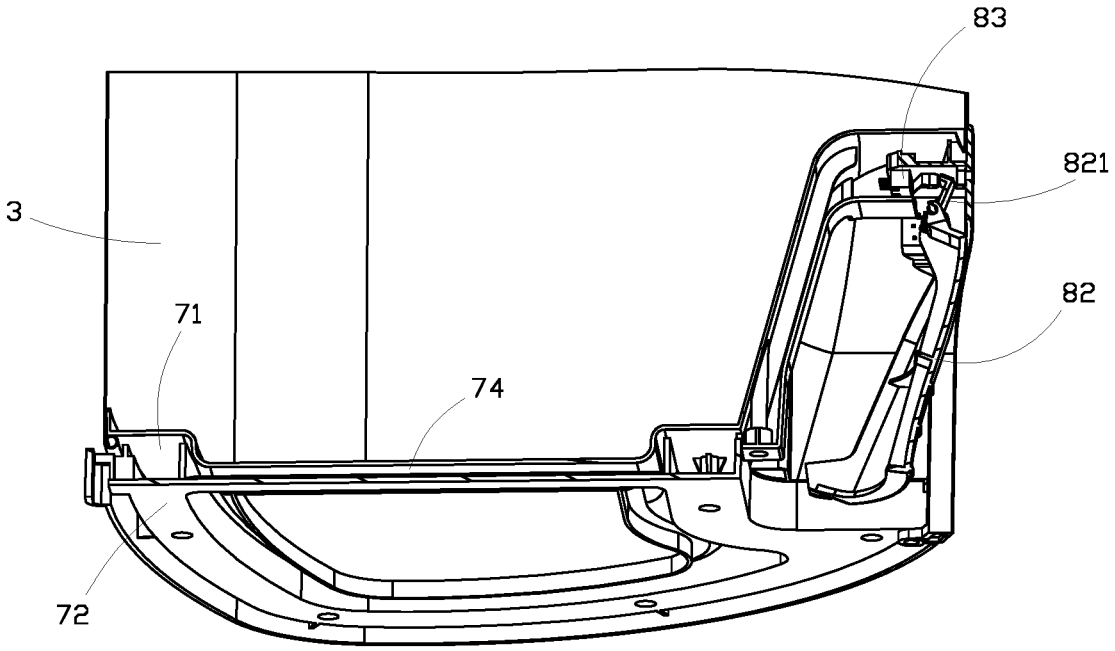
FIG. 11 is a partially bottom perspective view of the container according to the above preferred embodiment of the present invention.
Figure 12:
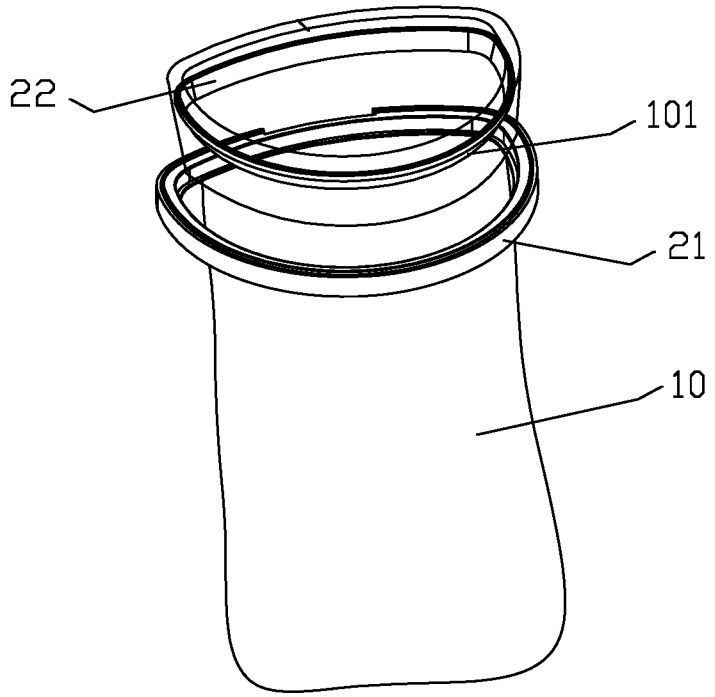
FIG. 12 illustrates inner and outer holding rings of the container according to the above preferred embodiment of the present invention, illustrating the trash bag held by the inner and outer holding rings.
Figure 13:
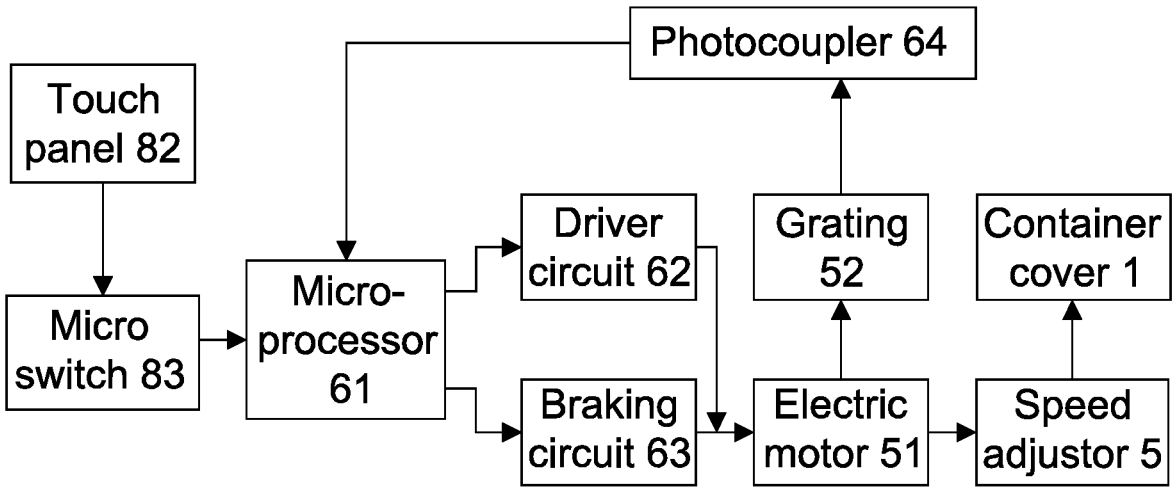
FIG. 13 is a block diagram of the touch control arrangement of the container according to the above preferred embodiment of the present invention.
Figure 14:
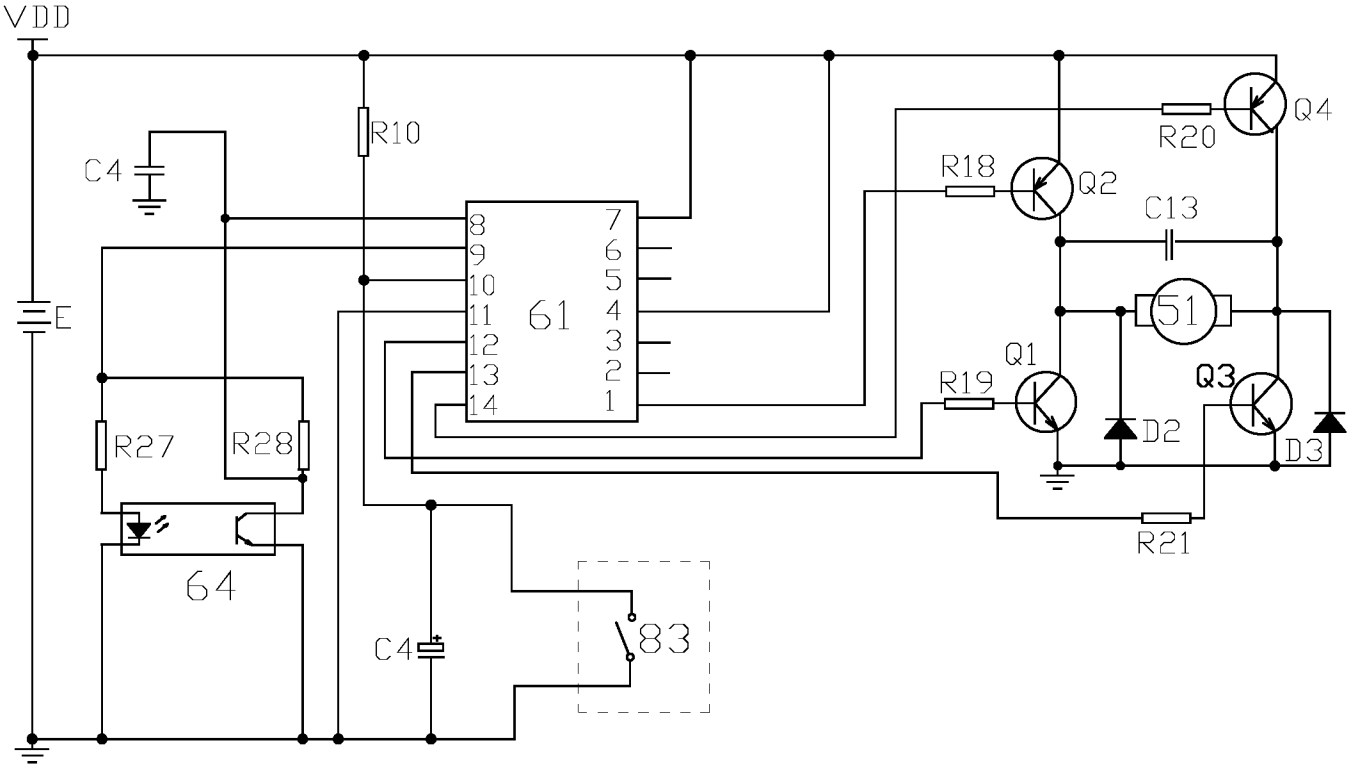
FIG. 14 is a circuit diagram of the touch control arrangement of the container according to the above preferred embodiment of the present invention.

Referring to FIGS. 1-14 of the drawings, a container according to a preferred embodiment of the present invention is illustrated, wherein the container, which is embodied as a trash container as an example, comprises a container cover 1, a cover resilient element 13, a holding unit which comprises an outer holding ring 21 and an inner holding ring 22, a container body 3, a connecting unit 4, a speed adjustor 5 such as a decelerator, an electric motor 51, a circuit board module 6, an inner supporting frame 71, an outer supporting frame 72, a touch control arrangement 8. The container cover 1 is pivotally connected to the container body 3 via the connecting unit 4, wherein the connecting unit 4 is coupled at an outer side of the container body 3 to pivotally connect to the container cover 1. In particular, the container cover 1 has two cover axle slots 12 and connecting unit 4 has two connecting axle slots 41 coaxially aligned with the cover axle slots 12, wherein an axle shaft is extended through the cover axle slot 14 and the connecting axle slot 41 to pivotally connect the container cover 1 to the container body 3. The cover resilient element 13 is coupled at the axle shaft to bias against the container cover 1 and the container body 3. The inner supporting frame 71 and the outer supporting frame 72 are mounted at the bottom of the container body 3, wherein a front opening cavity 73 is formed in front of the inner supporting frame 71 and the outer supporting frame 72. The container body 3 has a notch 31 aligned with the front opening cavity 73 to form an accessing cavity 85 which cannot communicated with an interior of the container body 3, wherein the touch control arrangement 8 is supported at the accessing cavity 85. In one embodiment, the cover resilient element 13 is a coil spring and is arranged for applying a resilient force against the container cover 1 with respect to the container body 3. In particular, the resilient force, i.e. the spring force, of the cover resilient element 13 will compensate or withstand most of the weight of the container cover 1. As a result, the electric motor 51 requires generating less power to pivotally lift up the container cover 1 from the container body 3. In other words, the size of the electric motor 3 as proportional to its power generation and the cost of the electric motor 3 will be reduced, so as to prolong the service life span of the electric motor 3. Accordingly, the connecting unit 4, the speed adjustor 5, the electric motor 51, the circuit board module 6, and a battery are supported and installed at the outer side of the container body 3 to maximize an interior storage cavity of the container body 3. In addition, the connecting unit 4, the speed adjustor 5, the electric motor 51, the circuit board module 6, and the battery are located at the rear side of the container body 3 to keep the aesthetic appearance of the container body 3. The touch control arrangement 8 is supported within the accessing cavity 85 at the front bottom side of the container body 3 to form an integrated body for keeping the aesthetic appearance of the container body 3.

The container cover 1 comprises a sector gear 11 provided at a rear bottom portion thereof and at a position between the cover axle slots 12, wherein the sector gear 11 is engaged with an output gear 54 of the speed adjustor 5. The connecting axle slots 41 are formed at an upper portion of the container body 3, wherein the connecting unit 4 has a planner shape that lower portion thereof is coupled at the container body 3. Accordingly, an axis of the sector gear 11, a center of each of the cover axle slots 12, and a center of each of the connecting axle slots 41 are coaxially aligned with each other to form a pivot axle channel, such that the axle shaft 14, which is preferably made of metal, is slidably coupled at the pivot axle channel to pivotally connect the container cover 1 with the connecting unit 4, so as to pivotally connect the container cover 1 with the container body 3. It is worth mentioning that the container cover 1, the sector gear 11, and the cover axle slots 12 are integrally formed as a one piece member via mold injection. In other words, the sector gear 11 is integrally extended from the container cover 1 while the cover axle slots 12 are integrally formed at the upper portion of the container cover 1 when the container cover 1 is formed via mold injection, so as to ensure the precise configuration of the sector gear 11 and the cover axle slots 12 with respect to the container cover 1 and to reduce the manufacturing cost thereof. The output gear 54 is directly engaged with the sector gear 11 to enhance the gear efficiency and to minimize the mechanical wear out of the gear. Preferably, the axle shaft 14 is made of metal to provide a high strength ability to prevent any distortion through the pivotal movement of the container cover 1. In addition, the cover resilient element 13 is coupled at the axle shaft 14, wherein the cover resilient element 13 has one end biasing against the connecting unit 4 and another end biasing against the container cover 1 for applying the upward resilient force against the container cover 1 so as to compensate most of the weight of the container cover 1.

The connecting unit 4 further comprises a battery compartment 43 integrally formed therein via mold injection for receiving one or more batteries in the battery compartment 43. Accordingly, the speed adjustor 5, the electric motor 51, the circuit board module 6 are orderly mounted at the connecting unit 4 from top to bottom thereof to form a power assembly, such that the electric motor 51 is located between the speed adjustor 5 and the circuit board module 6. The connecting unit 4 is coupled at the rear upper side of the container body 3 via screws. A unit casing 44 is detachably coupled at the connecting unit 4 to enclose the speed adjustor 5, the electric motor 51, the circuit board module 6. It is worth mentioning that speed adjustor 5, the electric motor 51, the circuit board module 6 can be manufactured individually or separately for enhancing the mass production of the components and for reducing the costs thereof.

The touch control arrangement 8 comprises a touch supporting frame 81, a touch panel 82, a micro switch 83, and a touch control resilient element 84. The touch supporting frame 81 is coupled at the notch 31 of the container body 3, wherein an upper portion of the touch supporting frame 81 is coupled at the inner supporting frame 71 while a lower portion of the touch supporting frame 81 is coupled at the outer supporting frame 72. The touch panel 82 is pivotally coupled at the touch supporting frame 81. In one embodiment, an upper portion of the touch panel 82 is pivotally coupled at the upper portion of the touch supporting frame 81, such that a bottom portion of the touch panel 82 is adapted to pivotally move into the touch supporting frame 81. The touch control resilient element 84 is coupled at the touch supporting frame 81 at a pivot connection between the touch supporting frame 81 and the touch panel 82. The micro switch 83 is supported by the touch supporting frame 81. The touch panel 82 comprises an actuating member 821 protruded from an inner side thereof and alignedly contacted with the micro switch 83. In one embodiment, the touch control resilient element 84 comprises a coil spring for applying an outward resilient force to the touch panel 82. When the touch panel 82 is pivotally pushed inward by a user's foot to compress the touch control resilient element 84, the actuating member 821 is driven to move away from the micro switch 83. It is worth mentioning that the pivot angle of the touch panel 82 is relatively small in order to disengage the actuating member 821 with the micro switch 83. Accordingly, the micro switch 83 is electrified to generate an activation signal to the circuit board module 6. When the user's foot moves away from the touch panel 82, the touch control resilient element 84 is then restored to its original form to pivotally push the touch panel 82 back to its original position, such that the actuating member 821 is moved back to re-contact with the micro switch 83. The micro switch 83 is disconnected (deactivated) once the actuating member 821 is contacted with the micro switch 83.

The circuit board module 6 comprises a microprocessor 61, a driver circuit 62, a braking circuit 63, and a photocoupler 64. The electric motor 51 comprises a first output shaft at one side as a first output side and a second output shaft at an opposed side as a second output side. The first output shaft of the electric motor 51 is engaged with a primary gear of the speed adjustor 5. The second output shaft of the electric motor 51 is connected to a grating 52 to rotate the grating 52. The grating 52 is arranged to selectively block a light ray from the photocoupler 64 which is supported at the connecting unit 4. The microprocessor 61 has an input terminal (terminal 10) electrically connected to the micro switch 83. The driver circuit 62 is constructed to have transistors Q1-Q4 and resistors R18-R21. The braking circuit 63 is constructed to have transistors Q1 and Q3, resistors R19 and R21, and diodes D2 and D3. Control terminals of the driver circuit 62 and the braking circuit 63 are electrically coupled to the output terminals (terminal 1, terminal 12, terminal 13 and terminal 14) of the microprocessor 61. A signal output terminal of the photocoupler 64 is electrically connected to the calculating terminal (terminal 8) of the microprocessor 61. When the electric motor 51 is activated to generate a rotatable power, the first output shaft of the electric motor 51 is driven to rotate to rotate the primary gear of the speed adjustor 5 so as to pivotally lift up the container cover 1 through the speed adjustor 5 to control the speed, preferably slow down the opening/closing speed, of the container cover 1. At the same time, the second output shaft of the electric motor 51 is driven to rotate to rotate the grating 52. The photocoupler 64 generates an impulse signal, wherein the microprocessor 61 will receive and determine the impulse signal. The microprocessor 61 will then continuously generate a feedback value with respect to a pivot angle (opening angle) of the container cover 1. Accordingly, the electric motor 51 is electrically connected and disconnected in response to the current feedback value.

A wiring slot 74 is formed between the inner supporting frame 71 and the outer supporting frame 72. A wiring panel 9 is coupled at the outer rear side of the container body 3. Accordingly, the micro switch 83 comprises a connecting wire 831 extended through the wiring slot 74 between the inner supporting frame 71 and the outer supporting frame 72, and is detoured and guided along the wiring panel 9 in a hidden manner in order to connect with the circuit board module 6. One side of the wiring panel 9 is coupled at the outer supporting frame 72 while another opposed side of the wiring panel 9 is coupled at the connecting unit 4 to protect and hide the connecting wire. The wiring panel 9 has an elongated strap structure and is arranged to protectively cover the connecting wire 831.

The holding unit is constructed to have the outer holding ring 21 and the inner holding ring 22. The outer holding ring 21 is detachably sleeved to and encircled around a top opening of the container body 3 at the outer side thereof while the inner holding ring 22 is detachably coupled at the top opening of the container body 3 at the inner side thereof and is encircled within the outer holding ring 21. Accordingly, an opening edge portion 101 of a plastic bag (trash bag) is held by the outer holding ring 21 and the inner holding ring 22. In particularly, when the plastic bag is disposed in the container body 3, the inner holding ring 22 is coupled at an inner side of the container body 3 to hold the opening edge portion 101 of the plastic bag between the inner side of the container body 3 and the inner holding ring 22. Then, the opening edge portion 101 of the plastic bag can be outwardly folded to overlap on an outer side of the container body 3, such that the outer holding ring 21 is coupled at the outer side of the container body 3 to hold the folded opening edge portion 101 of the plastic bag between the outer side of the container body 3 and the outer holding ring 21. Therefore, the container of the present invention does not require any inner container body to hold the plastic bag to further reduce the manufacturing cost of the container. Since the folded opening edge portion of the plastic bag is encircled and hidden within the outer holding ring 21, the plastic bag cannot be seen from the exterior of the container so as to keep the aesthetic appearance of the container.

The input terminal (terminal 10) of the microprocessor 61 also has a re-activation function from a sleep mode thereof and a timer function. It is worth mentioning that the input terminal (terminal 10) of the microprocessor 61 is electrically connected to the micro switch 83, wherein when the micro switch 83 is actuated, the electrical level at the input terminal (terminal 10) of the microprocessor 61 is changed from high level to low level. Therefore, the micro switch 83 is shifted from the sleep mode (energy saving mode) back to a normal operation mode for opening the container cover 1. At the opening position of the container cover 1, when the micro switch 83 is kept activated (the touch panel 82 is pressed inwardly and held for a predetermined time) to maintain the electrical level at the input terminal (terminal 10) of the microprocessor 61 at the low level and the activation time of the micro switch 83 is larger than 3 seconds, the microprocessor 61 is programmed to maintain the container cover 1 at the opening position (the container cover 1 stays at the opening position). When the activation time of the micro switch 83 is less than 3 seconds, the container cover 1 will be automatically moved back to its closed position from the opened position after the container cover 1 is stayed at the opened position for a predetermined time (few seconds). Then, the micro switch 83 is then shifted back to the sleep mode (energy saving mode) from the normal operation mode, so as to complete one working cycle.

The advantages of the present invention is that the structural configuration of the container is simplified and reasonable that the container requires less components and less complicated structural configuration comparing to the conventional container. The cost and the power consumption of the container are relatively low. The container is easy to use and is able to maintain the container cover 1 the opening position.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A container, comprising:

a container body having a top opening;

a container cover, which comprises two cover axle slots and a sector gear located between said cover axle slots, adapted to cover said top opening of said container body, wherein said sector gear is integrally formed with said container cover to form a one piece structure;

a connecting body having a lower portion coupled at an outer rear upper side of said container body and an upper portion pivotally coupled at said container cover to pivotally couple said container cover with said container body;

a power assembly mounted on said connecting body, wherein said power assembly comprises a speed adjustor engaged with said sector gear, an electric motor coupled to said speed adjustor, and a circuit board module arranged to activate said electric motor for pivotally moving said container cover with respect to said container body in a speed controllable manner via said speed adjustor; and a touch control arrangement which comprises an accessing cavity formed at a front bottom side of said container body, a touch panel pivotally coupled at said accessing cavity, and a micro switch supported in said accessing cavity to electrically connect with said circuit board module, wherein when said touch panel is pressed inwardly to actuate said micro switch, said circuit board module is activated to pivotally lift up said container cover, via said electric motor, from a closed position to an opened position and to determine whether said container cover is maintained at said opened position.

2. The container, as recited in claim 1, wherein said sector gear is mold-infected and integrally formed with a rear bottom portion of said container cover while said cover axle slots are integrally formed at said container cover to ensure a precise configuration of said sector gear between said cover axle slots.

3. The container, as recited in claim 2, further comprising an axle shaft, wherein said connecting unit, having a planner shape, has a lower portion coupled at said container body and two connecting slots formed at an upper portion of said connecting unit, wherein an axis of said sector gear, a center of each of said cover axle slots, and a center of each of said connecting axle slots are coaxially aligned with each other to form a pivot axle channel, such that said axle shaft is slidably coupled at said pivot axle channel to pivotally connect said container cover with said connecting unit.

4. The container, as recited in claim 3, further comprising a cover resilient element, which is coupled at said axle shaft, has one end biasing against said connecting unit and another end biasing against said container cover for applying an upward resilient force against said container cover to compensate a portion of weight of said container cover.

5. The container, as recited in claim 1, wherein said touch control arrangement further comprises a touch supporting frame coupled at said accessing cavity to pivotally couple with said touch panel, and a touch control resilient element coupled at said touch supporting frame for applying an outward resilient force against said touch panel.

6. The container, as recited in claim 5, wherein said touch panel comprises an actuating member protruded from an inner side thereof and alignedly contacted with said micro switch, such that when said touch panel is pivotally pressed inward, said actuating member is moved away from said micro switch and said micro switch is electrified to actuate said electric motor, and that when said touch panel is pivotally moved back by said touch control resilient element to re-contact said actuating member with said micro switch, said micro switch is deactivated.

7. The container, as recited in claim 6, wherein when said touch panel is kept being pressed and held for a predetermined time, said micro switch is kept being activated to maintain said container cover at said opened position.

8. The container, as recited in claim 1, further comprising a photocoupler supported at said connecting unit and a grating arranged to selectively block a light ray from said photocoupler, wherein said electric motor has a first output side operatively coupled at said speed adjustor and an opposed second output side connected to said grating to rotate said grating.

9. The container, as recited in claim 7, further comprising a photocoupler supported at said connecting unit and a grating arranged to selectively block a light ray from said photocoupler, wherein said electric motor has a first output side operatively coupled at said speed adjustor and an opposed second output side connected to said grating to rotate said grating.

10. The container, as recited in claim 9, further comprising an inner supporting frame and an outer supporting frame respectively mounted at a bottom of said container body, wherein said outer supporting frame has a front opening cavity while said container body has a notch aligned with said front opening cavity to form said accessing cavity.

11. The container, as recited in claim 10, wherein said micro switch comprises a connecting wire electrically connected to said circuit board module, wherein a wiring slot is formed between said inner supporting frame and said outer supporting frame, such that said connecting wire is extended through said wiring slot to electrically connect to said circuit board module.

12. The container, as recited in claim 11, further comprising a wiring panel coupled at said outer rear side of said container body, wherein said connecting wire is extended along said wiring panel in a hidden manner to electrically connect to said circuit board module through said wiring slot.

13. The container, as recited in claim 12, wherein one side of said wiring panel is coupled at said connecting unit and an opposed side of said wiring panel is coupled at said outer supporting frame to protect and hide said connecting wire within said wiring panel.

14. The container, as recited in claim 1, wherein said speed adjustor comprises an output gear directly engaged with said sector gear for slowing down opening and closing speeds of said container body.

15. The container, as recited in claim 13, wherein said speed adjustor comprises an output gear directly engaged with said sector gear for slowing down opening and closing speeds of said container body.

16. The container, as recited in claim 1, further comprising a unit casing detachably coupled at said connecting unit to enclose said power assembly.

17. The container, as recited in claim 15, further comprising a unit casing detachably coupled at said connecting unit to enclose said power assembly.

18. The container, as recited in claim 1, further comprising an outer holding ring coupled at said top opening of said container body at said outer side thereof and an inner holding ring which is coupled at said top opening of said container body at an inner side thereof and is encircled within said outer holding ring.

19. The container, as recited in claim 17, further comprising an outer holding ring coupled at said top opening of said container body at said outer side thereof and an inner holding ring which is coupled at said top opening of said container body at an inner side thereof and is encircled within said outer holding ring.

20. The container, as recited in claim 1, wherein said micro switch is shifted between a sleep mode and an operation mode.

* * * * *